US006086459A

United States Patent [19]

Naegelin

[11] Patent Number: 6,086,459

[45] Date of Patent: Jul. 11, 2000

[54] DEVICE FOR DEBURRING EDGES ON AN OBJECT

[75] Inventor: Thomas Naegelin, Ramlinsburg, Switzerland

[73] Assignee: Fraisa SA, Bellach, Switzerland

[21] Appl. No.: 09/287,450

[22] Filed: Apr. 7, 1999

[51] Int. Cl.[7] ..... B24B 1/00

[52] U.S. Cl. ..... 451/54; 451/55

[58] Field of Search ..... 451/38, 54, 48, 451/55, 28, 49, 60, 66, 75, 99, 102, 103, 443

[56] References Cited

U.S. PATENT DOCUMENTS 3,747,276 7/1973 Bridwell et al. .
4,711,056 12/1987 Herrington et al. ..... 451/38

FOREIGN PATENT DOCUMENTS 0293512 12/1988 European Pat. Off. .
0849044 4/1997 European Pat. Off. .
9147 3/1980 Germany .
61-197119 9/1986 Japan .

*Primary Examiner*—Derris H. Banks
*Attorney, Agent, or Firm*—Bachman & LaPointe, P.C.

[57] ABSTRACT

In a process for deburring edges on an object, for example the cutting edges (14) of a cutting tool (12), a fluid guided under high pressure through at least one nozzle (26) in the form of at least one fluid jet (28) is directed onto the edges with a speed sufficiently high to separate the burrs. A device for deburring the edges (14) of an object (12) with an axis of rotation (z) has a clamping means (16) for temporary clamping of the object (12) to be deburred and at least one fluid-carrying nozzle (26) arranged transverse to the axis of rotation (z) and aimed at the object (12), where the nozzles (26) and/or the clamping means (16) are designed to perform a rotational movement about the axis of rotation (z). Deburring is carried out carefully and without damaging or rounding the edges.

3 Claims, 1 Drawing Sheet

DEVICE FOR DEBURRING EDGES ON AN OBJECT

BACKGROUND OF THE INVENTION

The invention concerns a process for deburring edges on an object. The invention also includes a device for deburring edges on an object having an axis of rotation.

In the formation of edges on objects of all type, burrs are often left on the edges and must be removed for certain areas of application. In particular on objects which because of their application require a sharp-edged structure, careful deburring is essential. Careful deburring means that the burrs are completely removed but the object retains the sharp edges created during production.

In the production of cutting tools, a burr forms at the transition from the machined to unmachined surfaces. These burrs must be removed before first use of the cutting tool. Conventional deburring methods include finishing the cut edges by grinding, brushing or other mechanical abrasion processes. Polishing processes are also known in which the burrs are removed electrolytically.

In the deburring processes according to the state of the art, it has proved disadvantageous that both mechanical and the electrolytic deburring lead to a more or less pronounced rounding of the edges and hence for example a loss of cutting quality of such reworked cutting tools.

In addition to the said cutting tools in the area of tool technology, there are for example objects in the field of medical technology which require a high edge sharpness, such as for example self-cutting implants. Another area is machine technology where for example a turbine blade could be considered.

The invention is therefore based on the task of creating a process of the type described initially with which edges can be deburred in a careful manner without damage or rounding.

A further aim of the objective is to prepare a device for deburring edges on an object with an axis of rotation such as milling cutter, drill or thread cutter.

SUMMARY OF THE INVENTION

With regard to the process, the task is solved according to the invention in that a fluid guided under high pressure through at least one nozzle is directed onto the edges in the form of at least one fluid jet with a speed sufficiently high to separate the burrs.

Using the example of a cutting tool, it has been found that deburring by high pressure application of a fluid jet leads to careful deburring without damage or rounding of the edges. The preferred fluid is water, but depending on the properties of the material to be machined, other fluids such as oil for example can also be used. For certain areas of application it may also prove advantageous to mix into the fluid an additive in the form an abrasive agent. One example of an abrasive agent here is quartz sand, the grain size of which is adapted to the required abrasion conditions. The additive can reinforce the abrasive effect of the fluid.

The fluid pressure or speed with which the fluid jet meets the object with the edges to be deburred is set according to the material of which the object is made. For objects made conventionally of metallic materials such as for example cutting tools, the pressure range is between around 50 and 1000 bar, where for most materials for example titanium, 200 to 400 bar are adequate.

To achieve complete deburring, the fluid jet and the edges move in at least one direction relative to each other. For objects or tools with an axis of rotation it is also suitable for the object to perform a rotational movement and the fluid jets to be guided transverse, preferably.

A device suitable for deburring objects such as for example cutting tools with an axis of rotation comprises clamping means for temporary clamping of the object to be deburred and at least one fluid-carrying nozzle arranged transverse to the axis of rotation and aimed at the object, where the nozzle and/or the clamping means are designed to perform a rotational movement about the axis of rotation.

Preferably a multiplicity of nozzles are arranged in an annular fashion preferably axially symmetrical in relation to the axis of rotation. The nozzles can be arranged all in the same plane or spread over several planes. With an arrangement on several planes, a further shortening of the processing time for deburring can be achieved. One particularly suitable nozzle arrangement has the individual nozzles arranged on the inner periphery of a fluid-carrying ring.

For complete and even deburring of an object, e.g. a cutting tool, it has proved particularly advantageous if the nozzles and/or the clamping means can move relative to each other in the direction of the axis of rotation. An oscillating movement of the nozzles and/or the clamping means with a frequency of around 0.1 to 10 Hz, in particular 0.5 to 2 Hz, constitutes the preferred range for most materials.

BRIEF DESCRIPTION OF THE DRAWINGS

Further advantages, features and details of the invention arise from the description below of a preferred design example and the drawing which shows diagrammatically.

DETAILED DESCRIPTION OF THE DRAWINGS

Figure 1:
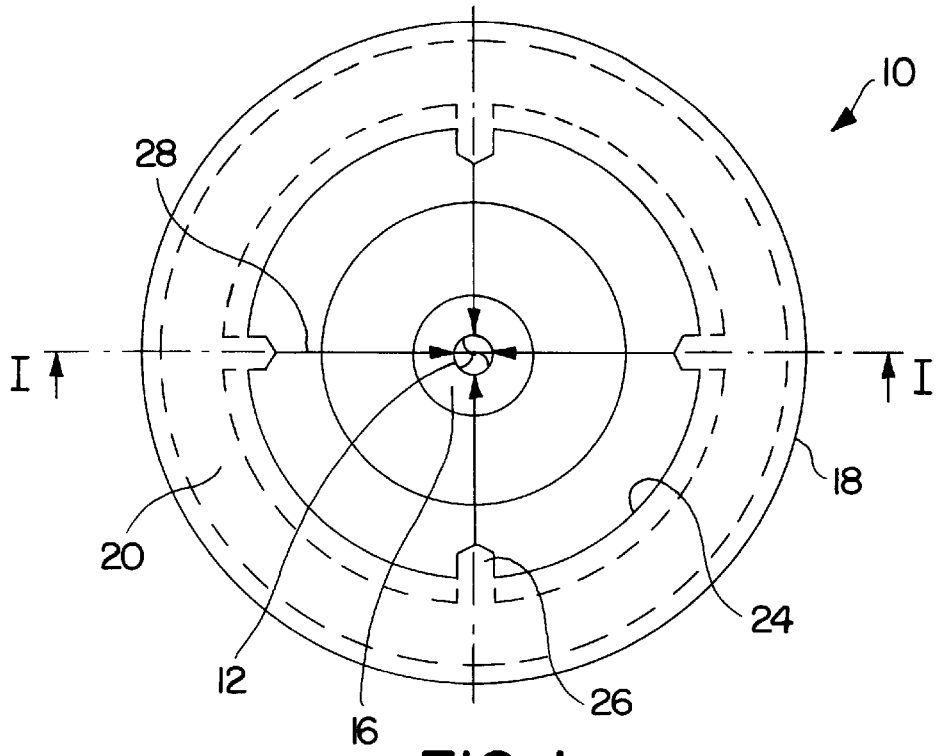
FIG. 1 a top view of a deburring device.
Figure 2:
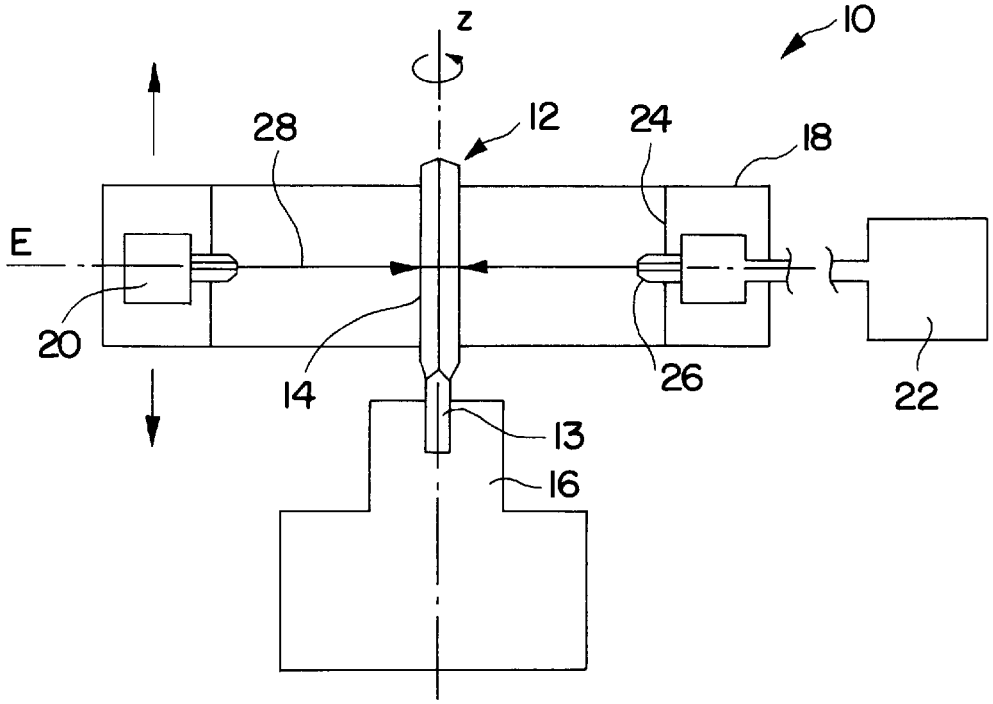
FIG. 2 a section through the device in FIG. 1 according to line I—I.

According to FIGS. 1 and 2, a deburring device 10 for deburring the cut edges 14 of a cutting tool 12 with an axis of rotation z, e.g. a thread cutter made of titanium, has a clamping head 16 for temporary holding of the cutting tool 10 and an annular spray device 18.

The cutting tool 12 is clamped by way of a shaft 13 in the clamping head 16 and can be rotated about the axis of rotation z by way of a rotational movement of the clamping head. The spray device 18 arranged coaxial to axis of rotation z has an annular duct 20 which is supplied with a fluid, preferably water, via a high pressure pump 22. The pressure in duct 20 is for example set at a value between 200 and 400 bar.

Nozzles 26 project from the inner wall 24 of the annular spray device 18. The nozzles 26 connected to the duct 20 are aimed at the axis of rotation z or the cutting tool 12 and lie in a common plane E. When the pump 22 is turned on, a fluid jet 28 emerges from the nozzles 26 at high speed. The water pressure and the internal diameter of the nozzles is preferably set such that the fluid jet 28 has a laminar flow behaviour.

The function of the deburring device is now explained in more detail using FIG. 2.

The clamping head 16 with the cutting tool 12 is rotated about axis z. The annular spray device 18 is moved to and fro between two end positions in the direction of axis of rotation z. The two end positions are selected such that the fluid jets 28 cover the entire length of the cutting edge 14. After pump 22 is switched on, fluid jets 28 emerge from nozzles 26 and hit the cutting tool 12 at high speed. By the oscillating movement of the spray device 18, which takes place for example at a frequency of 0.5 Hz, the said device covers the area of the cutting edge 14 in for example 3 to 5 cycles. Spray treatment at high pressure separates the burrs from the cutting edges.

The device shown in the drawing is suitable in principle for deburring cutting tools of any size. Preferably however the device according to the invention is used to deburr cutting tools with a shaft or tool diameter in the range between approximately 1 and 40 mm.

It is clear already from the description and the drawing that the process according to the invention and the device are suitable for deburring all types of objects, in addition to the said finishing of cutting tools, and are preferably used when careful deburring is necessary.

What is claimed is:

1. A device for deburring edges on an object mounted for rotation about a rotation axis (z) comprising a clamping means for temporary clamping of the object on the rotation axis (z), a fluid-carry ring having at least one nozzle arranged transverse to the rotation axis (z) and aimed at the object for directing fluid from the fluid-carrying ring onto the object during rotation of the object about the rotation axis (z), and means for moving the fluid-carrying ring and the clamping means relative to each other along the rotation axis (z).

2. A device according to claim 1, wherein a multiplicity of nozzles are arranged in an annular fashion on the fluid-carrying ring.

3. A device according to claim 1, wherein at least one of clamping means and fluid-carrying ring can move relative to each other with an oscillation frequency of 0.1 to 10 Hz.

* * * * *